US005565125A

United States Patent [19]

Parks

[11] Patent Number: 5,565,125

[45] Date of Patent: Oct. 15, 1996

[54] PRINTED MICROWAVE SUSCEPTOR WITH IMPROVED THERMAL AND MIGRATION PROTECTION

[75] Inventor: Christopher J. Parks, Ellicott City, Md.

[73] Assignee: Westvaco Corporation, New York, N.Y.

[21] Appl. No.: 328,113

[22] Filed: Oct. 24, 1994

[51] Int. Cl.[6] ..... H05B 6/80

[52] U.S. Cl. ..... 219/759; 219/730; 426/107; 426/243; 99/DIG. 14

[58] Field of Search ..... 219/730, 759; 426/107, 234, 241, 243; 99/DIG. 14

[56] References Cited

U.S. PATENT DOCUMENTS

| | | | |
|---|---|---|---|
| 4,713,510 | 12/1987 | Quick et al. | 219/730 |
| 4,735,513 | 4/1988 | Watkins et al. | 219/730 |
| 4,985,300 | 1/1991 | Huang | 428/332 |
| 4,985,606 | 1/1991 | Faller | 219/730 |
| 5,164,562 | 11/1992 | Huffman et al. | 219/730 |
| 5,343,024 | 8/1994 | Prosise et al. | 219/730 |

*Primary Examiner*—Philip H. Leung

[57] ABSTRACT

A printed microwave susceptor includes a paper or paperboard substrate having first and second surfaces. A food contact layer is applied to one surface, and separate thermal insulating layers and microwave interactive layers are applied to the other surface, with the thermal insulating layer being disposed between the substrate and the microwave interactive layer. The microwave interactive layer may be overcoated with a protective layer for abrasion resistance.

6 Claims, 1 Drawing Sheet

PRINTED MICROWAVE SUSCEPTOR WITH IMPROVED THERMAL AND MIGRATION PROTECTION

BACKGROUND OF INVENTION

The present invention involves microwave cooking. More particularly, the present invention relates to a printed microwave susceptor structure or package for safely cooking and browning foods in a microwave oven.

The cooking of foods in a microwave oven differs significantly from the cooking of foods in a conventional oven. In a conventional oven, heat energy is applied to the exterior of the surface of food, which moves inwardly until the food is cooked. Thus, food cooked conventionally is typically hot on the outer surfaces and warm in the center. Meanwhile, microwave cooking involves the absorption of microwave energy which characteristically penetrates far deeper into the food than does the heat energy in conventional cooking. Also, in microwave cooking, the air temperature in the microwave oven may be relatively low. Therefore, it is not uncommon for food cooked in a microwave oven to be cool on the outer surfaces and much hotter in the center.

Thus, in order to make the exterior surfaces of microwave cooked food brown and crisp, the exterior surfaces of the food must be heated to a sufficient degree such that moisture on the exterior surfaces of the food is driven away. Since the exterior surfaces of food cooked in a microwave oven are typically cooler than the interior of the food, it is difficult to brown food and make it crisp in a microwave oven. In order to facilitate the browning and crisping of food cooked in a microwave oven, devices known as susceptors have been developed. Susceptors are devices which, when exposed to microwave energy, become very hot. By placing a susceptor next to a food product in a microwave oven, the surface of the food product in contact with the susceptor is heated and becomes crisp.

A typical susceptor structure comprises a substrate such as paper or paperboard in combination with a microwave interactive material which absorbs microwave energy. For example, susceptor structures may be prepared using a thin layer of metal such as aluminum applied to a piece of film which is laminated to the substrate. Susceptors of this type are generally referred to as metallized structures. Other forms of susceptors may use coating, spraying or printing processes wherein a material capable of absorbing microwave energy is applied to the substrate. These susceptors are generally characterized as non-metallized structures. In the prior art constructions, the microwave interactive material is designed to be in direct contact with the food product, or as close as possible to the food product, separable therefrom only by a thin layer of paper, film, or the like. In fact, while there are literally hundreds of prior art United States patents granted for food packaging including the use of microwave susceptors, only a handful of these constructions have actually reached commercial use. The problems inherent in most prior art structures of the non-metallized type involve the development of hot spots, or uneven and runaway heating upon exposure to microwave energy, which causes charring and degradation of the paper or paperboard substrates during use, and the fear of potential migration of contaminants from the microwave interactive materials of the susceptor layer into the food products being cooked.

A number of attempts have been made in the past to overcome the development of hot spots and runaway heating in non-metallized susceptors including, the use of heat attenuators in the susceptor coating itself, or applied as an independent layer to the substrate (U.S. Pat. No. 5,285,040); the varying of the coverage of printed or coated microwave interactive materials between the regions of the packaging in contact with the food products, and the regions of the packaging adjacent to the food products (U.S. Pat. No. 4,970,358); and with the use of thermal barrier layers between the susceptor layer and the substrate (U.S. Pat. No. 5,231,268). The introduction of a thermal barrier layer between the susceptor layer and the substrate, as disclosed in the '268 patent, has for the most part solved the problem of charring and degradation of the substrate layer during use, but a practical solution to the problem of unwanted migration of contaminants from the microwave interactive materials in the susceptor layer has yet to be resolved.

At least some protection from migration of contaminants can be achieved by simply placing the microwave interactive material layer on the opposite side of the substrate from the food contact surface (U.S. Pat. Nos. 4,190,757 and 5,153,402). In like manner, the susceptor layer containing the microwave interactive material can be sandwiched between two substrates of different thickness (U.S. Pat. No. 5,012,068), or insulated from the substrate by multiple coatings (U.S. Pat. No. 5,006,405), to achieve some protection from migration of contaminants. However, there is a continuing need for the development of printed or coated microwave susceptor structures which are capable of controlled heating and which are safe for use.

SUMMARY OF INVENTION

The present invention is related to prior U.S. Pat. Nos. 5,132,144; 5,217,765; and, 5,231,268, the disclosures of which are incorporated herein by reference. Each of these prior patents describe microwave susceptor packaging materials which are printed with a microwave interactive susceptor-ink composition comprising graphite or conductive carbon black dispersed in a solution of sodium silicate.

According to the present invention, both the potential for migration of contaminants from the microwave interactive materials in the susceptor layer, and appropriate thermal protection for the substrate layer are achieved in the same construction. This desirable result is accomplished according to the present invention by placing the susceptor layer in a location as remote as possible from the food product, and incorporating into the susceptor the thermal insulation layer disclosed in the '268 patent. In a preferred embodiment, one surface of the paper or paperboard substrate is provided with a food contact layer, and the other surface is provided with a first layer of heat insulating material and a second layer of a microwave interactive susceptor material with the thermal layer being located between the substrate and the susceptor layer. Most preferably, the exposed susceptor layer is then overcoated with a protective layer of a material which protects the susceptor layer from abrasion and exposure to the elements. In this construction, the susceptor layer is separated from the food product by the thermal layer, the substrate and the food contact layer. This arrangement provides an effective barrier for reducing the possibility of contaminants migrating from the microwave interactive material of the susceptor layer into the food product during cooking, and further provides efficient thermal protection against the occurrence of hot spots or uneven heating that could char or degrade the substrate due to runaway heating.

DETAILED DESCRIPTION

Figure 1:
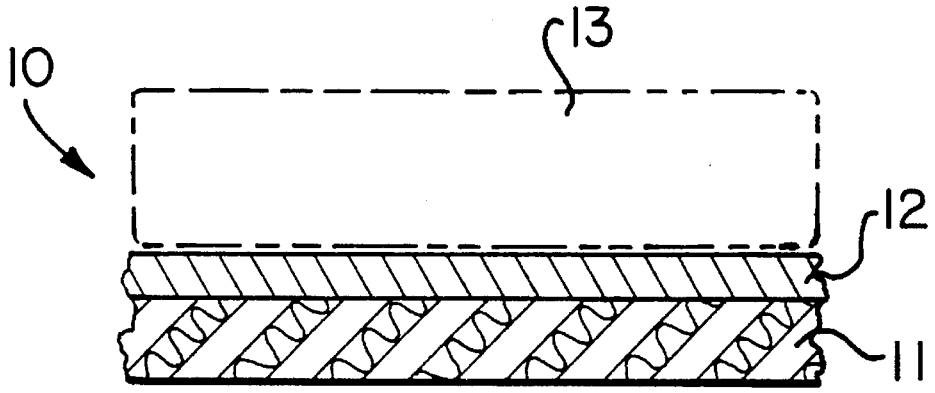
FIG. 1 (PRIOR ART)
FIG. 1 of the drawing shows in cross section the relative position of the components of a typical susceptor structure according to the prior art; and, FIG. 2 shows in cross section the relative position of the components of the susceptor structure according to the present invention.

With reference to FIG. 1 of the drawing, a typical non-metallized susceptor structure 10 of the prior art may be seen to comprise a substrate 11 of paper or paperboard, with a susceptor layer 12 applied directly to the substrate. Food product 13 cooked with the susceptor structure 10 is normally placed in direct contact with the susceptor layer 12. When the susceptor structure 10 is placed in a microwave oven and exposed to microwave energy, the microwave interactive materials in the susceptor layer 12 begin to heat up as a function of surface resistance. However, it has been observed that the susceptor layer does not heat up uniformly, and there may be a tendency for contaminants in the microwave interactive materials to migrate from the susceptor layer 12 into the adjacent food product 13 when exposed to microwave energy.

Figure 2:
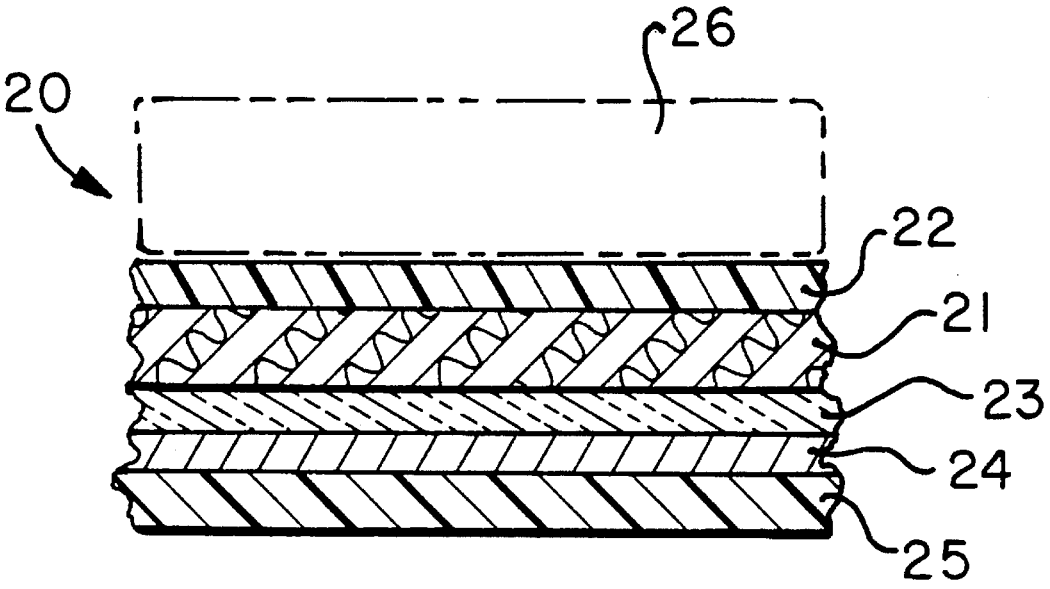

FIG. 2 illustrates a typical structure for the present invention. In the preferred embodiment shown, the susceptor structure 20 includes a paper or paperboard substrate 21 to which the other layers are applied. Substrate 21 supplies the structural rigidity for making a food package or an insert for a food package. Substrate 21 could also take the form of a light weight paper for applications where the susceptor structure is attached to another component of a package. In any event, the substrate 21 is preferably uncoated (e.g., no clay coating), to minimize the potential for migration of coating components into the food product 26 during microwave heating.

A food contact layer 22 is applied to one surface of the substrate 21. The food contact layer 22 serves as the food contact surface of the susceptor structure 20. Release properties are preferably incorporated into layer 22 so that cooked food products 26 may be readily separated from the susceptor structure 20. Suitable materials for use in the food contact layer 22 must be thermally stable up to about 400° F., and should meet FDA guidelines for food contact use with all food types under the conditions of use. An example of such a material is polyester supplied by DuPont under the tradename SELAR PT 7001. Other materials suitable for the food contact coating include acrylics and silicones, provided such materials have sufficient heat stability to withstand the temperatures normally reached by the microwave susceptor material when exposed to microwave energy.

Meanwhile, a thermal insulating layer 23 is applied to the opposite surface of substrate 21. Sodium silicate is the preferred material for layer 23 because of its good thermal properties as more fully disclosed in the aforementioned '268 patent. Sodium silicate readily adheres to the uncoated surface of the paper or paperboard substrate 21, and the subsequent adhesion of a susceptor layer 24 to the thermal layer 23, with sodium silicate as the binder, is easily achieved. Sodium silicate holds a large amount of bound water. Some of this water may be released to provide thermal protection for the substrate 21, when the susceptor layer 24 heats up due to microwave absorption. Efficient thermal control can be further enhanced by pigmenting the heat insulating layer 23 in order to create a more porous structure which will allow the water to escape layer 23 without causing blisters. Thus a thermal insulating coating containing sodium silicate and one or more pigments selected from the group consisting of clay, calcium carbonate, titanium dioxide or the like, could be used for layer 23.

Layer 24 is the microwave interactive material layer of susceptor structure 20. This layer preferably has at least two components, sodium silicate as binder and graphite as the microwave interactive component, particularly as described in the aforementioned '268 patent, in substantially the same amounts and proportions disclosed in that patent. Sodium silicate has the necessary thermal stability for the present invention unlike conventional printing ink binders such as ethylcellulose or nitro-cellulose, or unconventional printing ink binders such as acrylics or polyesters. While polyesters and acrylics may be suitable materials for the food contact layer 22 or the susceptor protective layer 25, these materials may not have the thermal stability required of the binder for the susceptor layer 24. Sodium silicate as used in the susceptor layer 24 of the present invention is fully disclosed in the '268 patent. Meanwhile, the preferred microwave interactive material useful for the present invention is particulate graphite. Particulate graphite is available in a wide range of particle sizes, shapes and purities. For gravure printing, a particle size less than about 100 microns is useful and less than about 10 microns is preferred. Superior graphite 5539 is a spherical graphite with particle size of about five microns and a purity of about 99.8% carbon. Ashbury graphite Micro 250 is similar to superior graphite 5539 with a particle size of about 0.5 micron. Each material has been used to prepare the susceptor layer 24 of the present invention. The ratio of graphite to sodium silicate solids for the susceptor layer of the present invention can range from about 1 to 20 up to 1 to 1. As an example, a ratio of one part Superior graphite 5539 to three parts sodium silicate 40 Clear, adjusted to a total solids content of about 40%, and applied to paperboard at the rate of about 20 lbs/3000 $ft^2$ has been used to make a susceptor structure according to the present invention which was useful to brown microwave pizza.

In order to provide some protection against damage, deterioration or abrasion of the susceptor layer 24, it is preferred according to the present invention to apply a protective layer 25 over the susceptor layer 24. Because the sodium silicate in the susceptor layer 24 is moisture sensitive, the protective layer 25 should also provide some degree of moisture vapor barrier. Protective layer 25 also aids in preventing the susceptor layer 24 from sticking to the bottom of the microwave oven during use, and provides an advantageous space between the susceptor layer 24 and the microwave oven which improves heating performance. Even though protective layer 25 does not necessarily have to meet FDA requirements for food contact, any of the commercially available food contact coatings such as those described hereinbefore for use in the food contact layer 22, would be useful for layer 25. Other materials compatible with the preferred binder/microwave interactive materials in susceptor layer 24, and having a non-porous structure would also be useful in layer 25.

Evaluation of the susceptor structure 20 described herein has shown that cooking performance is unaffected by the location of the susceptor layer 24 within the structure. However with the constructions shown, the potential for migration of susceptor components to the food product 26 has been minimized. Likewise the use of the preferred binder material (sodium silicate) in susceptor layer 24, and the presence of the thermal layer 23 as described herein prevents the substrate layer 21 from becoming overheated which could result in charring or deterioration and increase the occurrence of localized hot spots or runaway heating. In a preferred embodiment of the present invention a coating containing sodium silicate and clay in the ratio of about 3 to 1 is used to prepare the thermal layer 23. The addition of clay to the layer 23 makes the layer porous which allows moisture to be released without blistering the coating during microwave heating. The thickness of layer 23 determines the level of thermal protection, and for a typical paperboard substrate 21 prepared from 105# paperboard, the layer should be from about 10 to 30 lb/3000 $ft^2$ in coat weight.

Susceptor structure samples prepared according to the present invention were tested for volatile and non-volatile migration according to industry approved protocols. Temperature profiles using a pizza load were generated. The maximum temperature reached was about 430° F. Volatiles from the samples were between 25 and 39 micrograms per square inch. This result compared favorably with the results generated by metallized susceptors. Gravimetric non-volatiles testing generated roughly 200 micrograms per square inch. This value is about twice the amount produced by metallized susceptors.

In essence, the overall performance of the susceptor structure 20 of the present invention is improved over that of other non-metallized susceptors. The heating performance is not impaired because of the location of the susceptor layer within the susceptor structure, and the heretofore problems of hot spots and possible migration of microwave interactive materials from the susceptor layer is substantially reduced. The susceptor structure is useful for making packages for foods by selective printing of the microwave interactive materials on those parts of the package where the food contacts the packaging, and browning or crisping is desired. The susceptor structure disclosed herein could also be used to make inserts for use in food packages or for making inserts which may be patched into food packages where the food products contact the package.

Thus, although the present invention has been described with reference to a preferred embodiment, those skilled in the art will recognize that changes may be made without departing from the spirit and scope of the invention as defined in the appended claims.

What is claimed is:

1. A susceptor structure for heating when exposed to microwave energy comprising:

(a) a substrate having an upper surface and a lower surface;

(b) a food contact layer through which heat energy may be transmitted applied to the upper surface of said substrate;

(c) a heat insulating layer for controlling the transmission of heat energy applied to the lower surface of said substrate;

(d) a microwave interactive susceptor layer capable of generating heat energy when exposed to microwave energy applied over the heat insulating layer, said heat insulating layer being in a position to control the transmission of heat energy generated by said susceptor layer to prevent the substrate from being overheated, and to prevent the migration of susceptor materials through the substrate and into the food contact layer when the susceptor structure is exposed to microwave energy; and, (e) an abrasion protection layer applied over the microwave interactive layer to provide resistance to abrasion for the microwave interactive layer.

2. The susceptor structure of claim 1 wherein the food contact layer is prepared from a material selected from the group consisting of polyesters, acrylics, and silicones.

3. The susceptor structure of claim 2 wherein the heat insulating layer comprises sodium silicate.

4. The susceptor structure of claim 3 wherein the microwave interactive layer comprises a mixture of graphite and sodium silicate.

5. The susceptor structure of claim 4 wherein the protective layer is prepared from a material selected from the group consisting of polyesters, acrylics, and silicones.

6. The susceptor structure of claim 5 wherein the substrate is paperboard.

* * * * *